US011506167B1

(12) United States Patent
Gopalakrishnan et al.

(10) Patent No.: US 11,506,167 B1
(45) Date of Patent: Nov. 22, 2022

(54) ULTRACAPACITOR TO AUGMENT STARTER SYSTEM DURING STARTING OF VEHICLE ENGINE

(71) Applicant: GM Global Technology Operations LLC, Detroit, MI (US)

(72) Inventors: Suresh Gopalakrishnan, Troy, MI (US); Chandra S. Namuduri, Troy, MI (US); Pranjal Sharma, Troy, MI (US)

(73) Assignee: GM GLOBAL TECHNOLOGY OPERATIONS LLC, Detroit, MI (US)

( * ) Notice: Subject to any disclaimer, the term of this patent is extended or adjusted under 35 U.S.C. 154(b) by 0 days.

(21) Appl. No.: 17/397,326

(22) Filed: Aug. 9, 2021

(51) Int. Cl.
*F02N 11/00* (2006.01)
*F02N 11/08* (2006.01)

(52) U.S. Cl.
CPC ..... *F02N 11/0862* (2013.01); *F02N 11/087* (2013.01); *F02N 2011/0885* (2013.01); *F02N 2011/0888* (2013.01)

(58) Field of Classification Search
CPC ..... F02N 2011/0885; F02N 2011/0888; F02N 2011/0877; F02N 11/0866
USPC ..... 307/10.6
See application file for complete search history.

(56) References Cited

U.S. PATENT DOCUMENTS 5,155,374 A * 10/1992 Shirata ..... F02N 11/0866 290/38 R
6,605,921 B2 * 8/2003 Osada ..... F02N 11/14 320/104
9,184,624 B2 * 11/2015 Froeschl ..... H02J 1/08
9,915,239 B2 * 3/2018 Hashim ..... F02N 11/0866
10,436,167 B1 * 10/2019 Namuduri ..... H02K 7/006
10,907,603 B2 * 2/2021 Caballero Atienzar ..... F02N 11/14
2003/0042873 A1 * 3/2003 Osada ..... F02N 11/0825 320/166
2006/0133007 A1 * 6/2006 Shiue ..... H02P 7/28 361/301.2
2008/0246443 A1 * 10/2008 Doljack ..... H02J 7/345 320/167
2010/0244459 A1 * 9/2010 Gibson ..... F02N 11/0866 307/10.6
2011/0298277 A1 * 12/2011 Daunas ..... F02N 11/0866 307/10.6
2012/0139487 A1 * 6/2012 Kim ..... H02J 1/108 320/109
2012/0237799 A1 * 9/2012 Jiang ..... H01M 16/00 429/7
2013/0062940 A1 * 3/2013 Winkler ..... H02J 7/14 307/10.1
2014/0132063 A1 * 5/2014 Kakiuchi ..... B60R 16/03 307/9.1
2014/0346864 A1 * 11/2014 Chemin ..... H02J 7/345 307/10.6
2014/0346865 A1 * 11/2014 Akashi ..... B60L 50/40 307/10.7
2016/0040642 A1 * 2/2016 Miyake ..... F02N 11/0866 290/31

(Continued)

*Primary Examiner* — Phutthiwat Wongwian
*Assistant Examiner* — Sherman D Manley
(74) *Attorney, Agent, or Firm* — Cantor Colburn LLP

(57) ABSTRACT

A system in a vehicle includes a starter motor to start an engine of the vehicle and a battery configured to power the starter motor during the start of the engine. An ultracapacitor is controllably connected in series with the battery to provide additional power to the starter motor during the start of the engine.

14 Claims, 8 Drawing Sheets

(56) References Cited

U.S. PATENT DOCUMENTS

| | | | | |
|---|---|---|---|---|
| 2016/0176298 | A1* | 6/2016 | Watson | H01M 10/052 307/10.6 |
| 2016/0243960 | A1* | 8/2016 | Wood | H02J 7/345 |
| 2016/0268058 | A1* | 9/2016 | Postiglione | H01G 11/28 |
| 2017/0120849 | A1* | 5/2017 | Reichow | B60L 50/13 |
| 2017/0276113 | A1* | 9/2017 | Hashim | F02N 11/0866 |
| 2018/0083469 | A1* | 3/2018 | Bauer | F02N 19/001 |

* cited by examiner

ULTRACAPACITOR TO AUGMENT STARTER SYSTEM DURING STARTING OF VEHICLE ENGINE

INTRODUCTION

The subject disclosure relates to an ultracapacitor (ultracap) to augment the starter system during the starting of a vehicle engine.

Vehicles (e.g., automobiles, trucks, construction equipment, farm equipment) that have diesel or gasoline engines typically use a starter motor to start the engine. The engine must be turned at some speed to make it start operating (e.g., taking fuel and air into the cylinders and compressing the mixture). This initial turning is done by a starter motor whose gear wheel (i.e., pinion gear) engages with a larger gear ring around the rim of the engine flywheel. The starter motor may also be used during travel in vehicles that include a start-stop system, which shuts off the engine during idling (e.g., at a traffic light) to conserve fuel and limit emissions and restarts the engine when the brake is released. For vehicles with large engines, such as eight cylinder (e.g., V8) engines, the typical starter system may be insufficient in certain conditions such as cold weather. Accordingly, it is desirable to provide an ultracap to augment the starter system during starting of a vehicle engine.

SUMMARY

In one exemplary embodiment, a system in a vehicle includes a starter motor to start an engine of the vehicle and a battery to power the starter motor during the start of the engine. An ultracapacitor is controllably connected in series with the battery to provide additional power to the starter motor during the start of the engine.

In addition to one or more of the features described herein, the system also includes a switch to control connection of the ultracapacitor to the battery.

In addition to one or more of the features described herein, the switch is an electrically controlled switch or an electronic switching device.

In addition to one or more of the features described herein, the switch is a single pole double throw switch and is configured to connect the battery directly to the starter motor based on a first output and is configured to connect the battery in series with the ultracapacitor to the starter motor based on a second output.

In addition to one or more of the features described herein, the switch either connects the battery in series with the ultracapacitor to the starter motor or disconnects the battery from the starter motor.

In addition to one or more of the features described herein, the system also includes a second switch, wherein the second switch controllably connects the battery directly to the starter motor.

In addition to one or more of the features described herein, the system also includes a controller to control the second switch to connect the battery directly to the starter motor based on the switch being configured to disconnect the battery from the starter motor.

In addition to one or more of the features described herein, the system also includes a second switch and a generator. The second switch controllably connects the generator to the ultracapacitor to charge the ultracapacitor.

In addition to one or more of the features described herein, the system also includes a direct current (DC) to DC converter coupled to the ultracapacitor to recharge the ultracapacitor.

In addition to one or more of the features described herein, the system also includes a charging circuit coupled to the ultracapacitor to recharge the ultracapacitor.

In another exemplary embodiment, a method of starting a vehicle engine includes coupling a starter motor to the engine, the starter motor configured to start the engine of the vehicle, and configuring a battery to power the starter motor during the start of the engine. The method also includes controllably connecting an ultracapacitor in series with the battery to provide additional power to the starter motor during the start of the engine.

In addition to one or more of the features described herein, the method also includes disposing a switch to control connection of the ultracapacitor to the battery.

In addition to one or more of the features described herein, the switch is an electrically controlled switch or an electronic switching device.

In addition to one or more of the features described herein, the switch is a single pole double throw switch and the method also includes controlling the switch to connect the battery directly to the starter motor based on a first output and to connect the battery in series with the ultracapacitor to the starter motor based on a second output.

In addition to one or more of the features described herein, the method also includes controlling the switch to either connect the battery in series with the ultracapacitor to the starter motor or disconnect the battery from the starter motor.

In addition to one or more of the features described herein, the method also includes disposing a second switch to controllably connect the battery directly to the starter motor.

In addition to one or more of the features described herein, the method also includes configuring a controller to control the second switch to connect the battery directly to the starter motor based on the switch disconnecting the battery from the starter motor.

In addition to one or more of the features described herein, the method also includes disposing a second switch to controllably connect a generator to the ultracapacitor to charge the ultracapacitor.

In addition to one or more of the features described herein, the method also includes coupling a direct current (DC) to DC converter to the ultracapacitor and configuring the DC to DC converter to recharge the ultracapacitor.

In addition to one or more of the features described herein, the method also includes coupling a charging circuit to the ultracapacitor and configuring the charging circuit to recharge the ultracapacitor.

The above features and advantages, and other features and advantages of the disclosure are readily apparent from the following detailed description when taken in connection with the accompanying drawings.

BRIEF DESCRIPTION OF THE DRAWINGS

Other features, advantages and details appear, by way of example only, in the following detailed description, the detailed description referring to the drawings in which.

DETAILED DESCRIPTION

Figure 1:
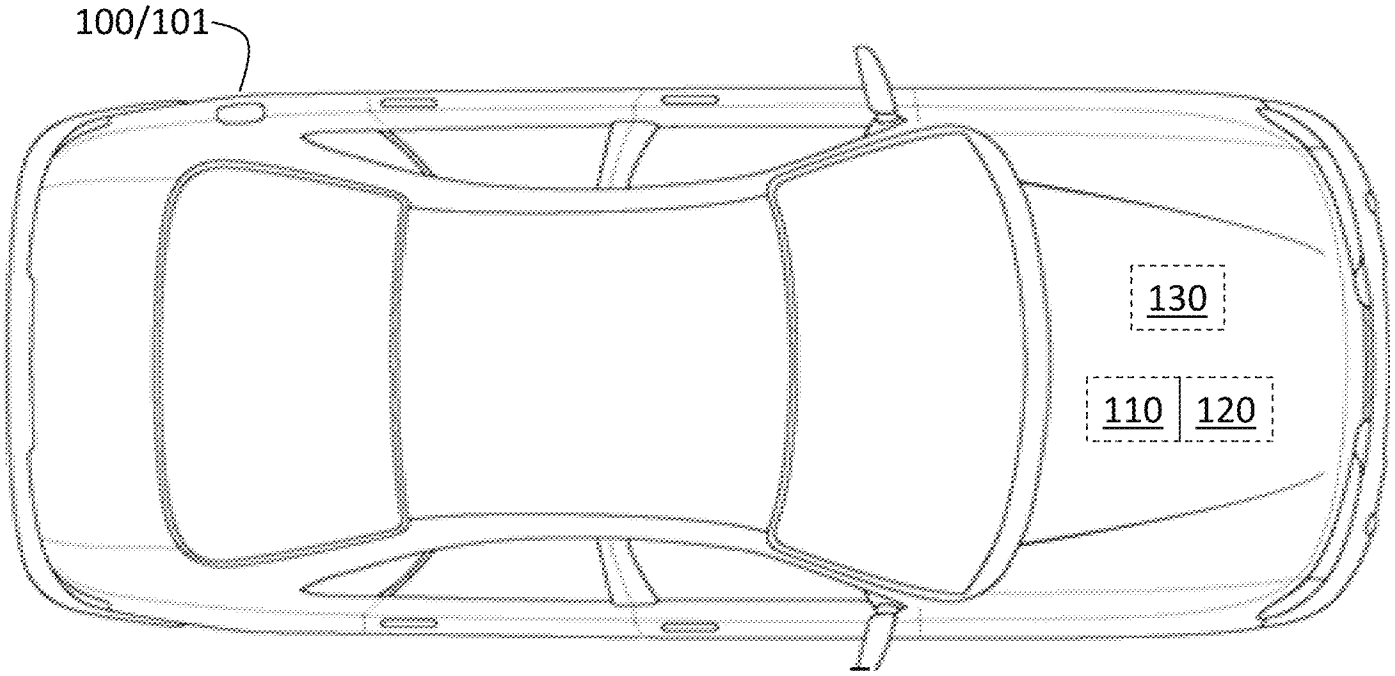
FIG. 1 is a block diagram of a vehicle with an ultracapacitor to augment the starter system during starting of the engine.

The following description is merely exemplary in nature and is not intended to limit the present disclosure, its application or uses. It should be understood that throughout the drawings, corresponding reference numerals indicate like or corresponding parts and features.

As previously noted, the starter system according to prior approaches, which generally includes one battery (e.g., 12 volt (V)), may be insufficient to start the vehicle engine under certain conditions, such as cold temperatures (e.g., below −20 degrees Fahrenheit). Ideally, during the starting process, the starter motor cranks the engine to a predefined cranking speed (e.g., 100 revolutions per minute (rpm)) without the engine subsequently dipping below a minimum cranking speed (e.g., 20 rpm). With the prior starter system, a V8 engine may dip to 4 rpm after initially reaching 100 rpm. This can result in poor start quality and negatively affect an established noise, vibration, harshness (NVH) metric.

Embodiments of the systems and methods detailed herein relate to an ultracap to augment the starter system during starting of a vehicle engine. An ultracap, also referred to as a supercapacitor, has a high power density. Significantly, ultracaps exhibit efficient operation in extremely cold temperatures. According to one or more embodiments, a battery may be coupled to the starter motor directly or in series with the ultracap. According to alternate embodiments, the battery is always coupled to the starter motor in series with the ultracap. Because recharge of an ultracap from 0 volts (V) can be time-consuming, a direct current (DC) to DC converter may be included, according to exemplary embodiments, to maintain a charge in the ultracap. Alternately or additionally, the generator that is used to recharge the battery may also charge the ultracap.

In accordance with an exemplary embodiment, FIG. 1 is a block diagram of a vehicle 100 with an ultracap 210 (FIG. 2) to augment the starter system 110 during starting of the engine 120. The exemplary vehicle 100 shown in FIG. 1 is an automobile 101. As indicated, the vehicle 100 includes the starter system 110 and the engine 120. During engine start, a gear wheel (not shown) of the starter system 110 engages with a larger gear ring (not shown) of the engine 120 to turn (i.e., crank) the engine 120. According to one or more embodiments, the starter system 110 is augmented to meet an established NVH metric when the engine 120 is started (i.e., cranked) under challenging conditions such as low temperatures or at any time. The vehicle 100 also includes a controller 130.

The controller 130 may control elements of the starter system 110, as further discussed, to augment the starter system 110, as needed. For example, the switches S, S2 shown in FIGS. 2, 4, and 5-7 may be mechanical contactors (i.e., electrically controlled switches) or solid state relays (i.e., electronic switching devices), for example, that are controlled by the controller 130, as further detailed. The controller 130 may include processing circuitry that may include an application specific integrated circuit (ASIC), an electronic circuit, a processor (shared, dedicated, or group) and memory that executes one or more software or firmware programs, a combinational logic circuit, and/or other suitable components that provide the described functionality.

Figure 2:
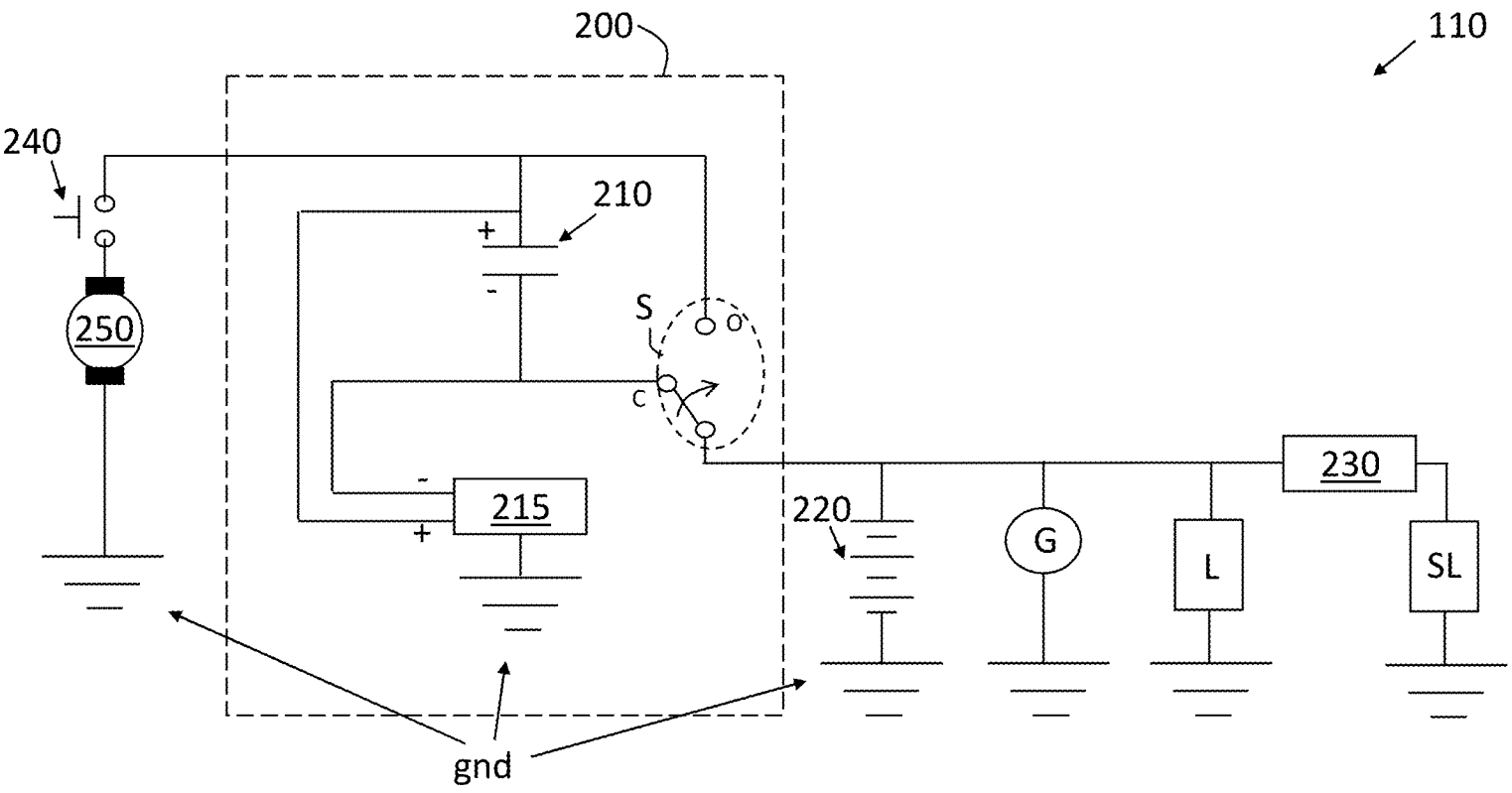
FIG. 2 is a schematic diagram of the starter system with an ultracapacitor to augment the starter system during starting of the engine according to an exemplary embodiment.

FIG. 2 is a schematic diagram of the starter system 110 with an ultracap 210 to augment the starter system 110 during starting of the engine 120 according to an exemplary embodiment. The augmented portion 200 of the starter system 110 is indicated. Without the augmented portion 200, the starter motor 250 is connected, via a relay 240, to a battery 220. The battery 220 alone powers the starter motor 250 during starting of the engine 120 according to a prior approach and under certain conditions (e.g., temperature not below a threshold value). According to one or more embodiments, the switch S of the augmented portion 200 is controlled to connect the ultracap 210 in series with the battery 220 during starting of the engine 120 under predefined conditions. One of more of the conditions may be referred to as cold cranking, for example (e.g., temperature below −20 degrees Fahrenheit and the vehicle 100 is a V8 powered truck).

The battery 220 may be an LN3 or LN4 battery. The increasing numbers following the "LN" designation indicate increased ampere-hours (Ah) but also increased size and weight (e.g., LN4 has higher Ah than LN0, LN1, or LN3). Charge balance analysis may be performed to select the battery 220. The battery 220 may be a 12 V battery while the ultracap 210 is charged up to 3 V through the DC to DC converter 215. Thus, with the ultracap 210 in series with the battery 220, the starter motor 250 may be started with 15 V. The size of the ultracap 210 and its initial pre-charge voltage may be selected based on model simulations (e.g., at various temperatures and under different engine start conditions).

The switch S shown in FIG. 2 is a single pole double throw (SPDT) switch, which has one input terminal that is always connected to one of two output terminals, labeled as open "o" and closed "c." The labels open "o" and closed "c" are used for explanatory purposes. These labels and the related description may be reversed without changing the functionality of the starter system 110. In the closed position "c," the switch S is configured to connect the battery 220 in series with the ultracap 210 and the starter motor 250, based on the configuration of the relay 240. In the open position "o," the switch S is configured to connect the battery 220 directly to the starter motor 250 through the relay 240, bypassing the ultracap 210. The controller 130 may control the switch S to be in the open position "o" under different scenarios. For example, when the engine 120 is being started in temperatures that are not below a threshold temperature or when the ultracap 210 or DC to DC converter 215 are unavailable due to any fault, the switch S may be controlled to be in the open "o" position.

Also shown in FIG. 2 are a generator G, loads L, sensitive loads SL, and a converter 230. Ground is indicated as "gnd."

The converter 230 may be a DC to DC converter that controls the voltage supplied to the sensitive loads SL that require a stable voltage. The generator G may be used to charge the battery 220 and may also supply the DC to DC converter 215 that charges the ultracap 210 when the switch S is in the closed position "c" and the engine 120 is not being started (i.e., the starter motor 250 is not being supplied).

Figure 3:
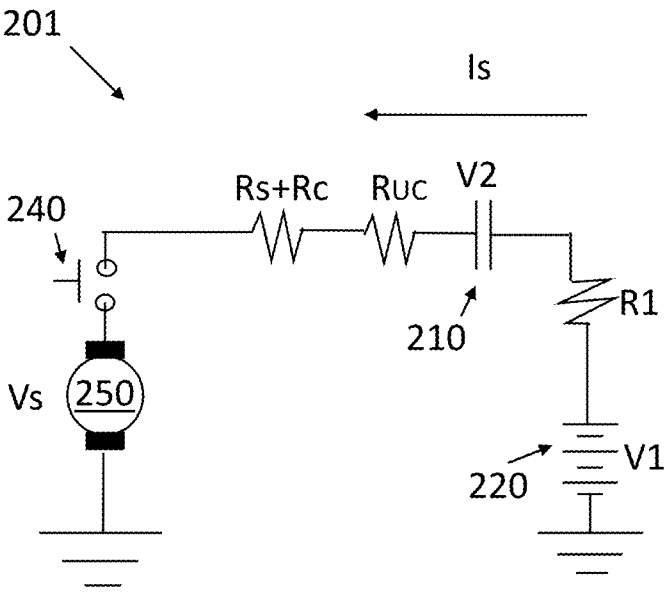
FIG. 3 is a circuit diagram of aspects of the starter system shown in FIG. 2.

FIG. 3 is a circuit diagram 201 of aspects of the starter system 110 shown in FIG. 2. Specifically, the starter motor 250, battery 220, and ultracap 210 are shown in the configuration that may be implemented during cold cranking (i.e., switch S is in the closed position "c" as shown in FIG. 2). As indicated, the battery 220 and ultracap 210 are connected in series. The voltages of the battery 220 and the ultracap 210 are V1 and V2, respectively. Based on that arrangement, the voltage Vs at the starter motor 250 will be V1+V2. As previously noted, the voltage V1 of the battery 220 may be 12 V and the voltage V2 at the ultracap 210 may be 3 V, for example. In this case, the voltage Vs at the starter motor 250 is 15 V. As a result of the increased voltage based on the ultracap 210, as compared with the battery 220 alone, the torque and speed at the starter motor 250 are increased. The increased torque and speed facilitate a smoother start (e.g., better NVH output) in conditions that may otherwise present a challenge for using the starter motor 250 with only the battery 220.

Figure 4:
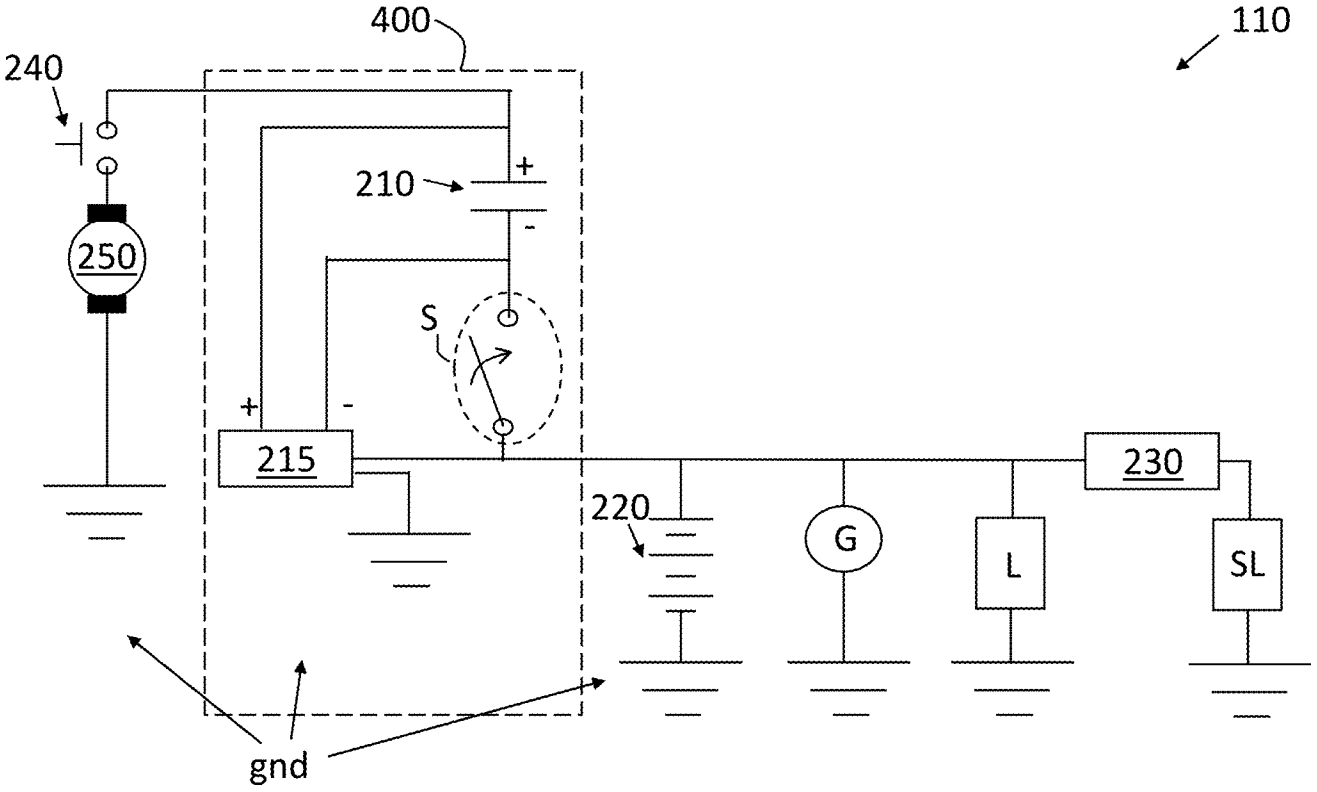
FIG. 4 is a schematic diagram of the starter system with an ultracapacitor to augment the starter system during starting of the engine according to an exemplary embodiment.

FIG. 4 is a schematic diagram of the starter system 110 with an ultracap 210 to augment the starter system 110 during starting of the engine 120 according to an exemplary embodiment. The augmented portion 400 of the starter system 110 is indicated. As previously noted, without the augmented portion 400, the starter motor 250 is connected, via the relay 240, to the battery 220, and the battery 220 alone powers the starter motor 250 during starting of the engine 120 according to a prior approach and under certain conditions (e.g., temperature not below a threshold value). According to one or more embodiments, the switch S of the augmented portion 400 is controlled (e.g., by the controller 130) to connect the ultracap 210 in series with the battery 220 during starting of the engine 120 under certain (e.g., cold cranking) conditions (e.g., when the temperature is below a threshold value and the vehicle 100 is of a particular type (e.g., has a V8 engine 120)).

The switch S shown in FIG. 4 is a single pole single throw (SPST) switch which has an input terminal that may or may not be connected to the single output terminal. Unlike the embodiment shown in FIG. 2, the embodiment shown in FIG. 4 does not facilitate connection between the battery 220 and the starter motor 250 without the ultracap 210 also being in series. That is, when the switch S is in the closed position, the battery 220 and ultracap 210 are connected in series to the starter motor 250, based on the configuration of the relay 240. However, when the switch S is in the open position, the battery 220 is disconnected from the ultracap 210 and also from the starter motor 250. Thus, according to this exemplary embodiment, the switch S may only be open when the ultracap 210 or DC to DC converter 215 become unavailable due to a fault. Otherwise, the switch S may always be closed and the ultracap 210 may augment starting of the engine 120 by the starter motor 250 under all circumstances.

Like the arrangement in FIG. 2, a generator G, loads L, sensitive loads SL, and a converter 230 are shown, and ground is indicated as "gnd." The generator G may be used to charge the battery 220 and the ultracap 210, via the DC to DC converter 215, when the engine 120 is not being started. That is, with the switch S in the open position, the DC to DC converter 215 may be supplied by the generator G following a cold cranking event, for example.

Figure 5:
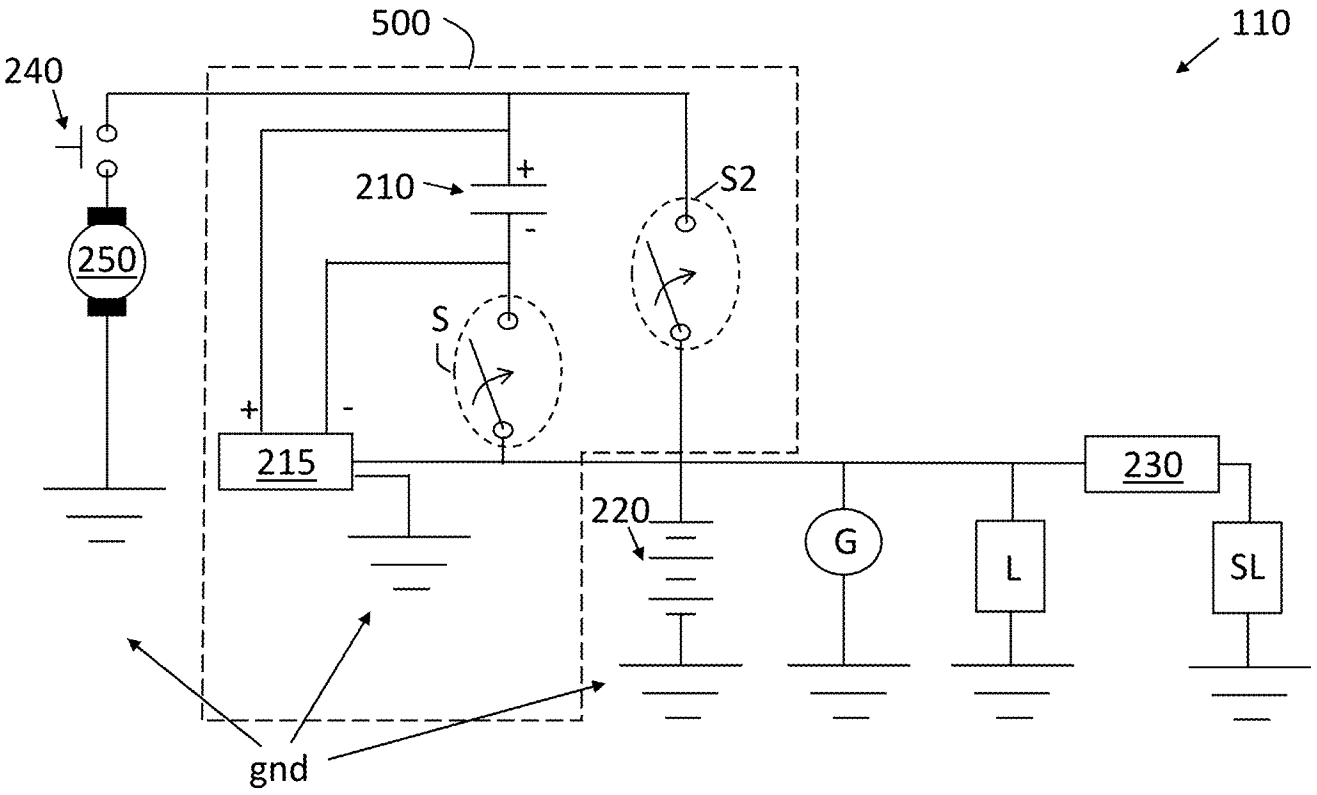
FIG. 5 is a schematic diagram of the starter system with an ultracapacitor to augment the starter system during starting of the engine according to an exemplary embodiment.

FIG. 5 is a schematic diagram of the starter system 110 with an ultracap 210 to augment the starter system 110 during starting of the engine 120 according to an exemplary embodiment. The augmented portion 500 of the starter system 110 is indicated. A comparison of FIGS. 4 and 5 indicates that the embodiment shown in FIG. 5 is similar to that of FIG. 4. However, a second switch S2 is added to facilitate bypassing the ultracap 210, as needed. The second switch S2, like the switch S, is an SPST switch that is either open or closed.

The controller 130 controls the switches S, S2 in a coordinated manner. That is, when the switch S is closed to connect the battery 220 in series to the ultracap 210, the switch S2 is opened. When the switch S is open due to a fault in the ultracap 210, for example, the switch S2 is closed to facilitate a connection between the battery 220 and the starter motor 250 via the relay 240. Thus, the embodiment shown in FIG. 5, unlike the embodiment shown in FIG. 4, facilitates powering the starter motor 250 with only the battery 220 and not additionally the ultracap 210. The generator G may supply the DC to DC converter when the switch S is closed (and the switch S2 is open).

Figure 6:
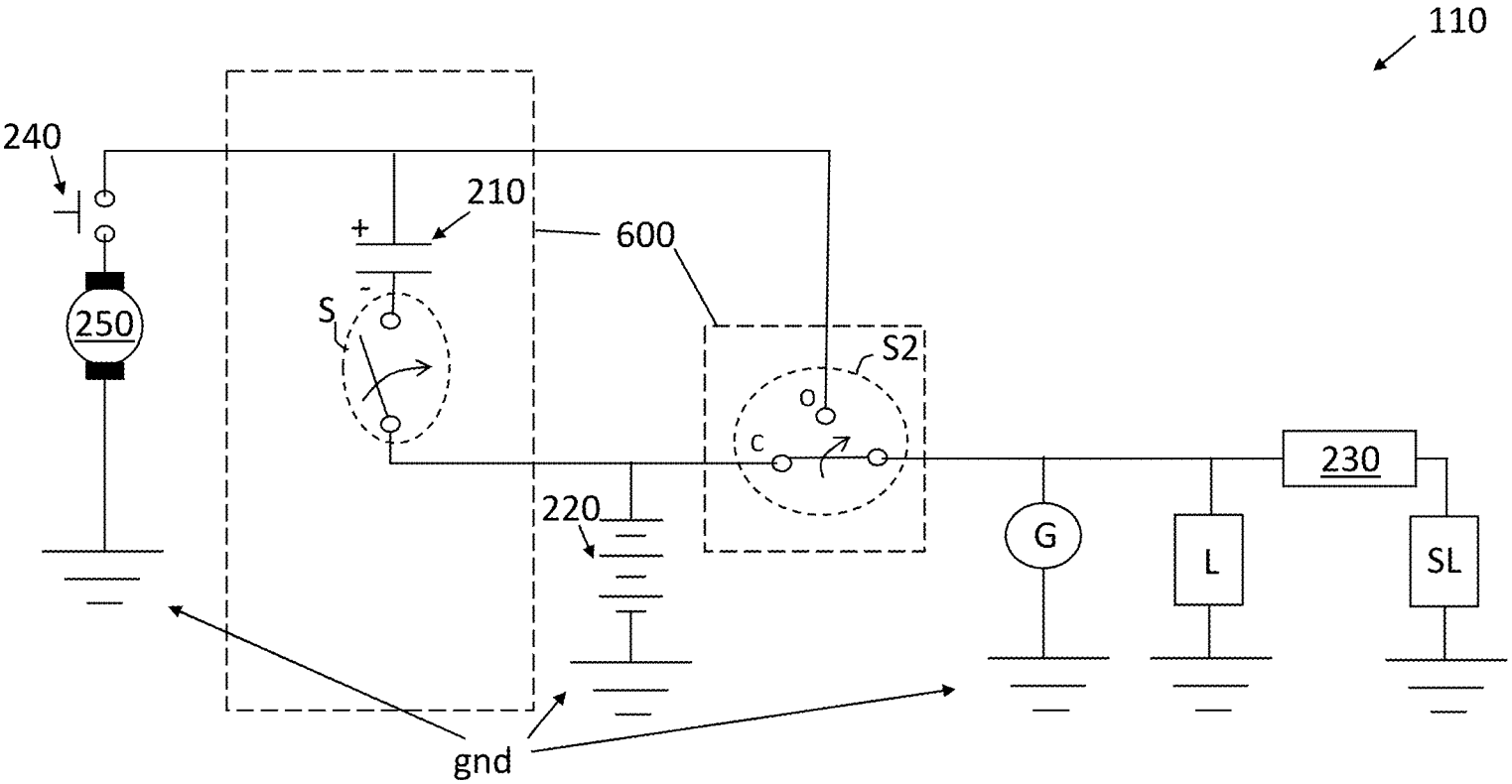
FIG. 6 is a schematic diagram of the starter system with an ultracapacitor to augment the starter system during starting of the engine according to an exemplary embodiment.

FIG. 6 is a schematic diagram of the starter system 110 with an ultracap 210 to augment the starter system 110 during starting of the engine 120 according to an exemplary embodiment. The augmented portion 600 of the starter system 110 is indicated. The augmented portion 600 includes an SPST switch S that connects the battery 220 to the ultracap 210 in series when closed. The augmented portion 600 also includes a second, SPDT switch S2 that facilitates a direct connection between the battery 220 and the starter motor 250, bypassing the ultracap 210 based on the relay 240. That is, when the switch S is closed to connect the battery 220 and the ultracap 210 in series, the switch S2 is in the closed position "c." When the switch S is open, the switch S2 being in the open position "o," connects the battery 220 to the starter motor 250 while bypassing the ultracap 210. After the cranking event, switch S2 may be moved to the open position "o" while the switch S may remain closed. This allows the generator G to charge the ultracap 210. After the generator G charges the ultracap 210 to a desired level, the switch S may be opened and the switch S2 may be moved to the closed position "c."

Unlike the embodiments shown in FIGS. 2, 4, and 5, the embodiment shown in FIG. 6 does not include a DC to DC converter 215 to charge the ultracap 210. Instead, the ultracap 210 is directly charged by the generator G. Specifically, following an augmented start, in which the battery 220 and the ultracap 210 are connected in series to supply the starter motor 250, the ultracap 210 may be recharged by the generator G. As previously noted, the switch S is closed and the switch S2 is in the closed position "c" for this augmented charge. Following the augmented start, with the switches S, S2 in the same positions, the generator G can recharge both the battery 220 and the ultracap 210.

Figure 7:
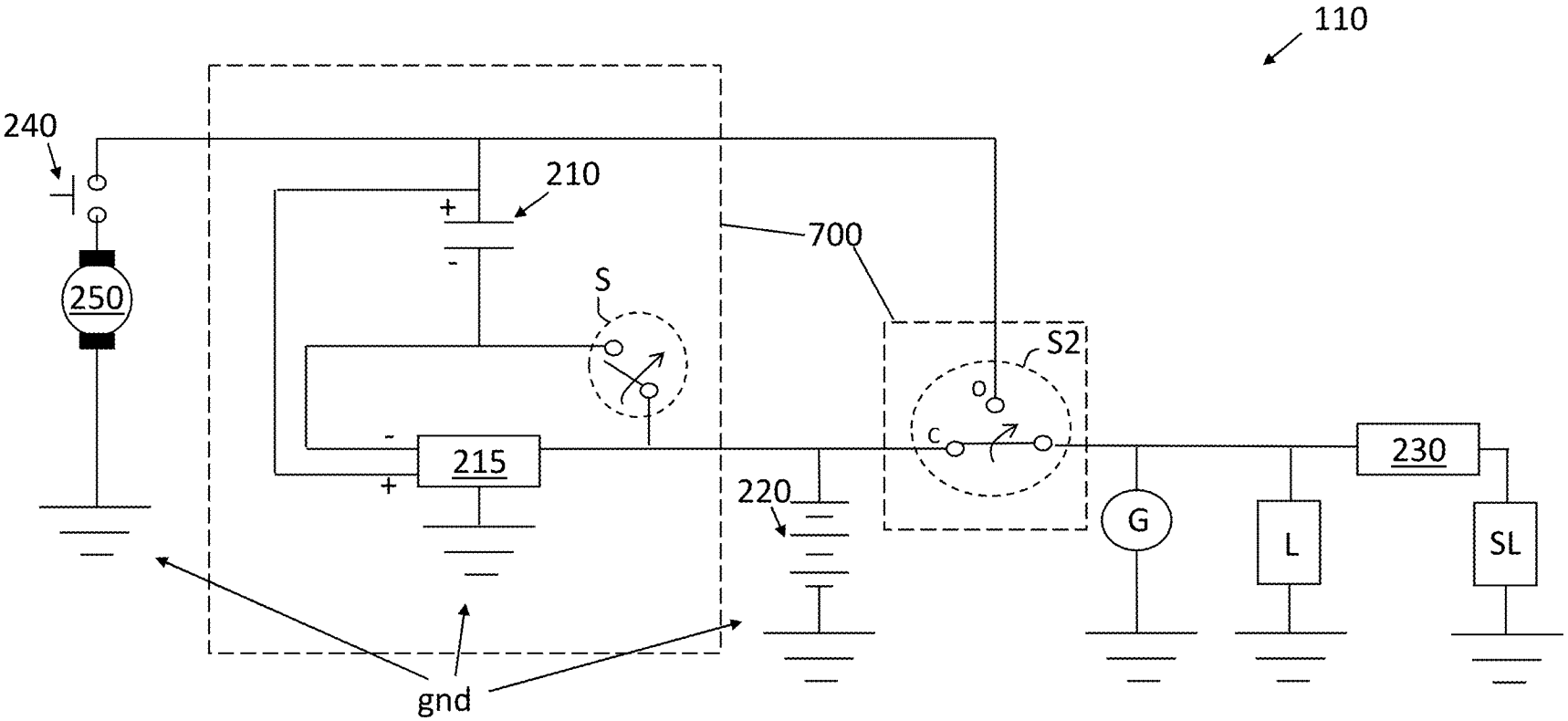
FIG. 7 is a schematic diagram of the starter system with an ultracapacitor to augment the starter system during starting of the engine according to an exemplary embodiment.

FIG. 7 is a schematic diagram of the starter system 110 with an ultracap 210 to augment the starter system 110 during starting of the engine 120 according to an exemplary embodiment. The augmented portion 700 of the starter system 110 is indicated. As in the embodiment shown in FIG. 6, the augmented portion 700 includes an SPST switch S that controllably connects the battery 220 and the ultracap 210 in series and also includes an SPDT switch S2 that facilitates connection of the battery 220 to the starter motor 250 while bypassing the ultracap 210. However, the augmented portion 700 also includes a DC to DC converter 215 to maintain the charge of the ultracap 210. The DC to DC converter 215 may be small (e.g., less than 1 watt (W)) or may be sized to supply the maximum leakage current (e.g., 12 milli Amps (mA)) of the ultracap 210.

As discussed with reference to FIG. 6, when the switch S is open, the switch S2 being in the open position "o," connects the battery 220 to the starter motor 250 while bypassing the ultracap 210. When the switch S is closed to connect the battery 220 and the ultracap 210 in series, the switch S2 is in the closed position "c." This represents an augmented start. Following an augmented start, the switch S may remain closed while the switch S2 is moved to an open position "o" so that the generator G can charge the ultracap 210 till the charge rises to a desired level.

Figure 8:
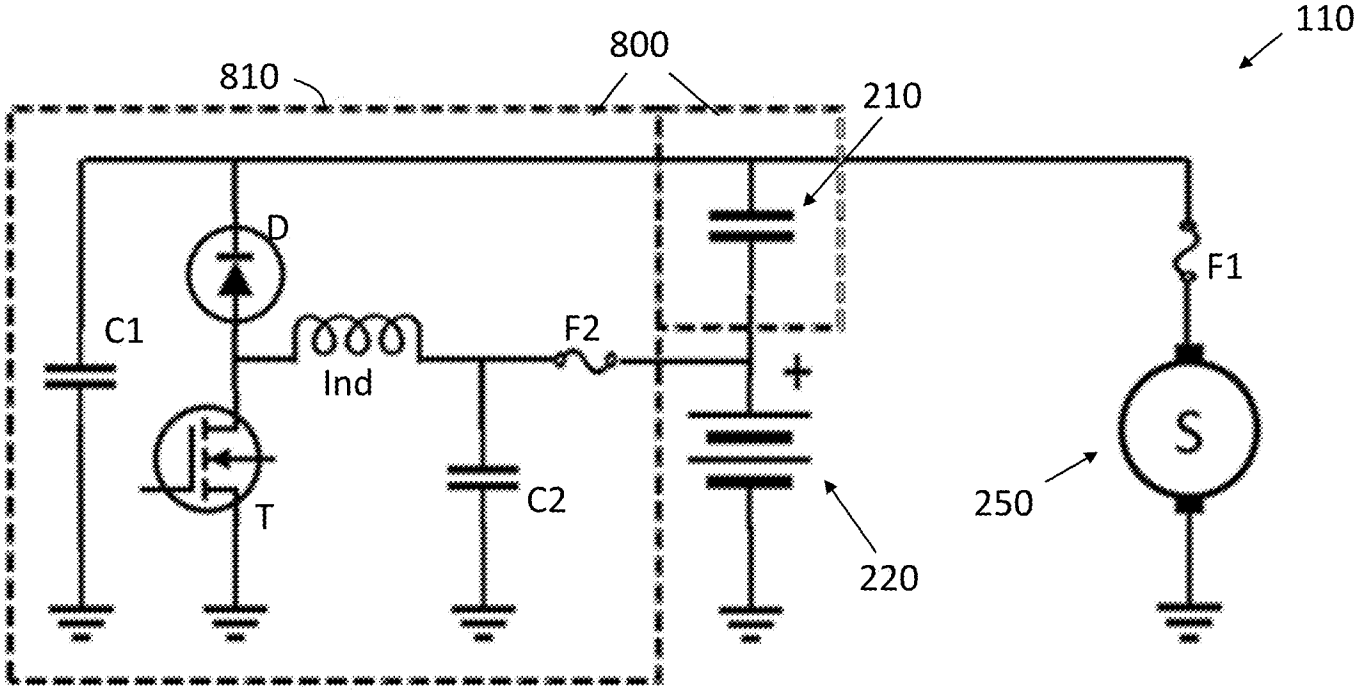
FIG. 8 is a schematic diagram of the starter system with an ultracapacitor to augment the starter system during starting of the engine according to an exemplary embodiment.

FIG. 8 is a schematic diagram of a starter system 110 with an ultracap 210 to augment the starter system 110 during starting of the engine 120 according to an exemplary embodiment. For simplicity, the ultracap 210 is shown connected in series with the battery 220. However, a switch S may be included to controllably connect the battery 220 in series with the ultracap 210 as shown for other embodiments. In addition, another switch S2 may be included to facilitate bypassing the ultracap 210 to connect the battery 220 to the starter motor 250 via the fuse Fl.

The augmented portion 800 includes not only the ultracap 210 but also a charging circuit 810 for the ultracap 210. This charging circuit includes two capacitors C1, C2, a switch T (e.g., a metal-oxide-semiconductor field effect transistor (MOSFET)), diode D, inductor Ind and a fuse F2. The charging circuit 810 may be used with any of the previously described embodiments.

While the above disclosure has been described with reference to exemplary embodiments, it will be understood by those skilled in the art that various changes may be made and equivalents may be substituted for elements thereof without departing from its scope. In addition, many modifications may be made to adapt a particular situation or material to the teachings of the disclosure without departing from the essential scope thereof. Therefore, it is intended that the present disclosure not be limited to the particular embodiments disclosed, but will include all embodiments falling within the scope thereof

What is claimed is:

1. A system in a vehicle comprising:

a starter motor configured to start an engine of the vehicle;

a battery configured to power the starter motor during the start of the engine; and an ultracapacitor controllably connected in series with the battery, by a switch that is a single pole double throw switch or a single pole single throw switch, to provide additional power to the starter motor during the start of the engine, wherein the ultracapacitor is recharged by a direct current (DC) to DC converter, a generator, or a charging circuit independent of the battery.

2. The system according to claim 1, wherein the switch is an electrically controlled switch or an electronic switching device.

3. The system according to claim 1, wherein the switch is the single pole double throw switch and is configured to connect the battery directly to the starter motor based on a first output and is configured to connect the battery in series with the ultracapacitor to the starter motor based on a second output.

4. The system according to claim 1, wherein the switch is single pole single throw switch and is configured to either connect the battery in series with the ultracapacitor to the starter motor or disconnect the battery from the starter motor.

5. The system according to claim 4, further comprising a second switch, wherein the second switch is configured to controllably connect the battery directly to the starter motor.

6. The system according to claim 5, further comprising a controller configured to control the second switch to connect the battery directly to the starter motor based on the switch being configured to disconnect the battery from the starter motor.

7. The system according to claim 1, further comprising a second switch and a generator, wherein the second switch is configured to controllably connect the generator to the ultracapacitor to charge the ultracapacitor.

8. A method of starting a vehicle engine, the method comprising:

coupling a starter motor to the engine, the starter motor configured to start the engine of the vehicle;

configuring a battery to power the starter motor during the start of the engine;

controllably connecting an ultracapacitor in series with the battery, via a switch that is a single pole double throw switch or a single pole single throw switch, to provide additional power to the starter motor during the start of the engine; and coupling a direct current (DC) to DC converter, a generator, or a charging circuit independent of the battery to the ultracapacitor to recharge the ultracapacitor.

9. The method according to claim 8, wherein the switch is an electrically controlled switch or an electronic switching device.

10. The method according to claim 8, wherein the switch is the single pole double throw switch and the method also includes controlling the switch to connect the battery directly to the starter motor based on a first output and to connect the battery in series with the ultracapacitor to the starter motor based on a second output.

11. The method according to claim 8, wherein the switch is the single pole single throw switch and the method further comprises controlling the switch to either connect the battery in series with the ultracapacitor to the starter motor or disconnect the battery from the starter motor.

12. The method according to claim 11, further comprising disposing a second switch to controllably connect the battery directly to the starter motor.

13. The method according to claim 12, further comprising configuring a controller to control the second switch to connect the battery directly to the starter motor based on the switch being configured to disconnect the battery from the starter motor.

14. The method according to claim 8, further comprising disposing a second switch to controllably connect a generator to the ultracapacitor to charge the ultracapacitor.

* * * * *